US011680420B1

(12) United States Patent
Barnes et al.

(10) Patent No.: US 11,680,420 B1
(45) Date of Patent: Jun. 20, 2023

(54) SWIMMING POOL INSERT AND RELATED INSTALLATION AND REPLACEMENT METHODS

(71) Applicant: Sun Ledges Unlimited, LLC, Americus, GA (US)

(72) Inventors: Russ Floyd Barnes, Americus, GA (US); Kenneth Dewey Kennedy, Dawson, GA (US); Richard Karl Campbell, Americus, GA (US); Joseph Perry Wilkinson, Leesburg, GA (US)

(73) Assignee: Sun Ledges Unlimited, LLC, Americus, GA (US)

( * ) Notice: Subject to any disclaimer, the term of this patent is extended or adjusted under 35 U.S.C. 154(b) by 0 days.

(21) Appl. No.: 17/682,970

(22) Filed: Feb. 28, 2022

(51) Int. Cl.
*E04H 4/14* (2006.01)

(52) U.S. Cl.
CPC ..... *E04H 4/144* (2013.01)

(58) Field of Classification Search
CPC ..... E04H 4/144
See application file for complete search history.

(56) References Cited

U.S. PATENT DOCUMENTS 3,478,370 A 11/1969 Stern et al.
5,333,322 A * 8/1994 Weir ..... E04H 4/14 4/578.1
5,727,264 A * 3/1998 Craig ..... E04H 4/144 4/489
9,345,852 B2 * 5/2016 Hill ..... A61H 33/6005
10,472,839 B2 11/2019 Khamis et al.
10,655,351 B1 * 5/2020 Sirco ..... E04F 11/00
2007/0039091 A1 * 2/2007 Foy ..... E04H 4/144 4/488
2008/0134426 A1 6/2008 Cronis et al.
2012/0297532 A1 11/2012 Gibson et al.
2014/0101839 A1 * 4/2014 Hoskinson ..... A61G 7/1059 4/496
2016/0206108 A1 * 7/2016 Müller ..... A47K 3/125
(Continued)

FOREIGN PATENT DOCUMENTS

EP 3779100 * 2/2021 ..... E04H 4/144

OTHER PUBLICATIONS

Latham Pools, Fiberglass and Vinyl Liner Pool Tanning Ledges, https://web.archive.org/web/20220130065434/https://www.lathampool.com/fiberglass-and-vinyl-liner-pool-tanning-ledges/, Jan. 30, 2022.
(Continued)

*Primary Examiner* — J C Jacyna
(74) *Attorney, Agent, or Firm* — Brient IP Law, LLC

(57) ABSTRACT

A tanning ledge insert for a swimming pool is provided. In various embodiments, the tanning ledge includes a fiberglass insert that is adapted for use within the context of a vinyl liner pool. A depth of the tanning ledge may be, for example, between 14 and 16 inches. However, in other embodiments, the tanning ledge may be of any other suitable depth. The tanning ledge insert may include a vertical wall and a tanning ledge extending horizontally from the vertical wall. A step may be disposed adjacent the tanning ledge's upper surface. The tanning ledge insert may include a connection lip that is dimensioned for use in securing the tanning ledge insert in place within the structure of a vinyl liner pool. Methods of installing and replacing the tanning ledge insert are also provided.

11 Claims, 8 Drawing Sheets

(56) References Cited

U.S. PATENT DOCUMENTS

| | | | | |
|---|---|---|---|---|
| 2019/0128003 | A1* | 5/2019 | Khamis | E04H 4/144 |
| 2022/0025669 | A1* | 1/2022 | McDermott | E06C 1/39 |
| 2022/0186511 | A1* | 6/2022 | Hobaica | E04H 4/0093 |

OTHER PUBLICATIONS

Mancha Hardscapes, Vinyl Liner Pool with Tanning Ledge and Spa, https://www.manchahardscapes.com/our-work/item/vinyl-liner-pool-with-tanning-ledge-and-spa, 2021.

Holly Jender, Are Tanning Ledges on Vinyl Liner Pools Really a Good Idea?, https://www.riverpoolsandspas.com/blog/tanning-ledges-on-vinyl-liner-pools, Apr. 17, 2019.

Royal Pools, How Can Vinyl Liner Pools be Customized?, https://royalpoolsandmore.com/blog/how-can-vinyl-liner-pools-be-customized/, Dec. 18, 2020.

Thursday Pools, Ask the General—What's the Lowdown on Tanning Ledges?, https://thursdaypools.com/blog/lowdown-tanning-ledges/, Sep. 22, 2020.

Tanning ledge issue with my vinyl lined pool, https://www.youtube.com/watch?v=5BHIwUU8Z6g, May 11, 2020.

Tanning Ledge in Vinyl Pool?, https://www.houzz.com/discussions/2523966/tanning-ledge-in-vinyl-pool, 2010.

Pool and Spa News, One-Piece Fiberglass Tanning Ledge, https://www.poolspanews.com/products/pools-and-backyard/one-piece-fiberglass-tanning-ledge_o, Dec. 15, 2014.

River Pools, The Roman Lounger 36—A Dry Tour Video by River Pools and Spas, https://www.youtube.com/watch?v=aMpu4aVWCco&t=79s, Nov. 10, 2016.

* cited by examiner

SWIMMING POOL INSERT AND RELATED INSTALLATION AND REPLACEMENT METHODS

BACKGROUND

Traditional swimming pools typically have sections of varying water depth to accommodate people of differing heights and swimming abilities, as well as different activities such as wading, swimming, and relaxing. Ordinarily, these sections range between three and ten feet deep. While these depths are suitable for wading and swimming, they may be undesirable for relaxing, as swimmers may prefer to relax in the water without having to focus on keeping their heads above water level. Further, small children or weak swimmers may be unable to safely enjoy pool sections over a certain depth.

Some makers of gunite pools sought to address this issue by creating tanning ledges in some of their pools. Such tanning ledges are typically shallow which may, for example, allow individuals to sit upright or in a chair while having part of their body submerged in the pool.

Although such tanning ledges would be desirable in pools with liners, providing a tanning ledge with a liner may be undesirable because liners can be easily torn when subjected to the additional wear and tear that occurs on tanning ledges. For example, the liner can be torn by the toenails of pets running on the tanning ledge or by chairs that are used on the tanning ledge. Accordingly, there is a need for an improved tanning ledge, and related installation methods, that can be used in conjunction with liner pools.

SUMMARY

It should be appreciated that this Summary is provided to introduce a selection of concepts in a simplified form that are further described in the Detailed Description section below. This Summary is not intended to be used to limit the scope of the claimed subject matter.

A tanning ledge insert, according to various embodiments, includes: (1) at least one vertical wall defining a vertical wall upper surface; (2) a tanning ledge extending horizontally from the at least one vertical wall and having a tanning ledge depth measured between a tanning ledge upper surface and the vertical wall upper surface; (3) a step disposed adjacent the tanning ledge upper surface, contacting the at least one vertical wall, and having a step height less than the tanning ledge depth; and (4) a connection lip configured to cooperate with a swimming pool wall to secure the tanning ledge insert.

In various embodiments, a method of constructing a swimming pool includes: (1) excavating a volume of earth; (2) constructing a pool frame substantially defining a perimeter of the swimming pool within the excavated volume; (3) providing a fiberglass tanning ledge insert; (4) setting the tanning ledge insert on ground supporting a pool bottom; (5) aligning a vertical wall upper surface with a top of the pool frame; and (6) securing a connection lip to the pool frame. In particular embodiments, the tanning ledge insert includes: (1) at least one vertical wall having a vertical wall upper surface and a vertical wall bottom surface; (2) a tanning ledge extending horizontally from the at least one vertical wall and having a tanning ledge depth measured between a tanning ledge upper surface and the vertical wall upper surface; (3) a step disposed adjacent the tanning ledge upper surface, contacting the at least one vertical wall, and having a step height less than the tanning ledge depth; and (4) a connection lip configured to cooperate with a swimming pool wall to secure the tanning ledge insert.

A method of upgrading a swimming pool, according to various embodiments, includes: (1) draining the swimming pool such that a pool insert disposed in a wall of the swimming pool is exposed above water; (2) detaching the pool insert from a vinyl liner of the swimming pool by separating an edge of the vinyl liner from a perimeter of the pool insert; (3) removing the pool insert; and (4) placing a tanning ledge insert in a space created by the removal of the pool insert. In particular embodiments, the tanning ledge insert includes: (1) at least one vertical wall having a vertical wall upper surface and a vertical wall bottom surface; (2) a tanning ledge extending horizontally from the at least one vertical wall and having a tanning ledge depth measured between a tanning ledge upper surface and the vertical wall upper surface; (3) a step disposed adjacent the tanning ledge upper surface, contacting the at least one vertical wall, and having a step height less than the tanning ledge depth; and (4) a connection lip configured to cooperate with a swimming pool wall to secure a portion of a perimeter of a vinyl pool liner.

BRIEF DESCRIPTION OF THE DRAWINGS

Various embodiments of the invention will be described below. In the course of the description, reference will be made to the accompanying drawings, which are not necessarily drawn to scale, and wherein.

DETAILED DESCRIPTION OF VARIOUS EMBODIMENTS

Various embodiments now will be described more fully hereinafter with reference to the accompanying drawings. It should be understood that the invention may be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

For the purposes of this disclosure, the term "tanning ledge" is used to describe a swimming pool feature that allows swimmers to relax in shallow water. Tanning ledges may be integrated into the pool such that swimmers can transition from resting on the tanning ledge to swimming in deeper water without leaving the water.

Utilizing the concepts and techniques described herein, a tanning ledge insert may be constructed in a variety of shapes and from a variety of materials. The tanning ledge insert may, in various embodiments, be delivered to a site and integrated into a pool that is under construction quickly and easily. The tanning ledge insert may be used in conjunction with, for example, a vinyl-lined swimming pool, a concrete swimming pool, or any other type of swimming pool. The tanning ledge insert may be added to the swimming pool in a variety of configurations, such as, for example, adjacent to or inside a perimeter of a swimming pool.

The tanning ledge insert may be integrated into a pool frame on site (e.g., at a construction site). For example, the tanning ledge insert may have features that connect (e.g., seat or mate) with a frame of a swimming pool, such as a frame of a vinyl-lined swimming pool.

Figure 1A:
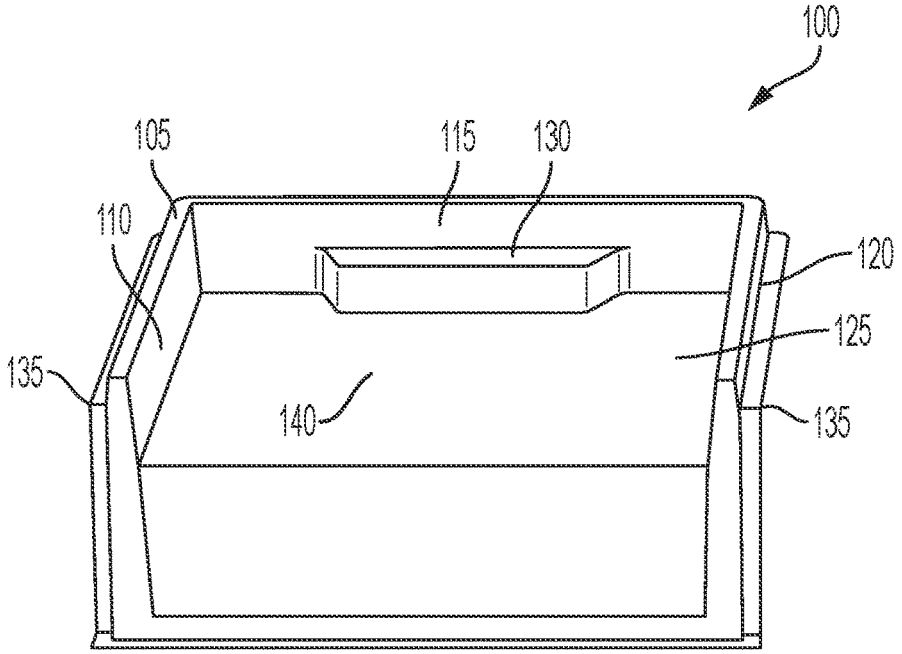
FIGS. 1A and 1B show perspective and plan views, respectively, of a tanning ledge insert according to various embodiments of the present disclosure.
Figure 1B:
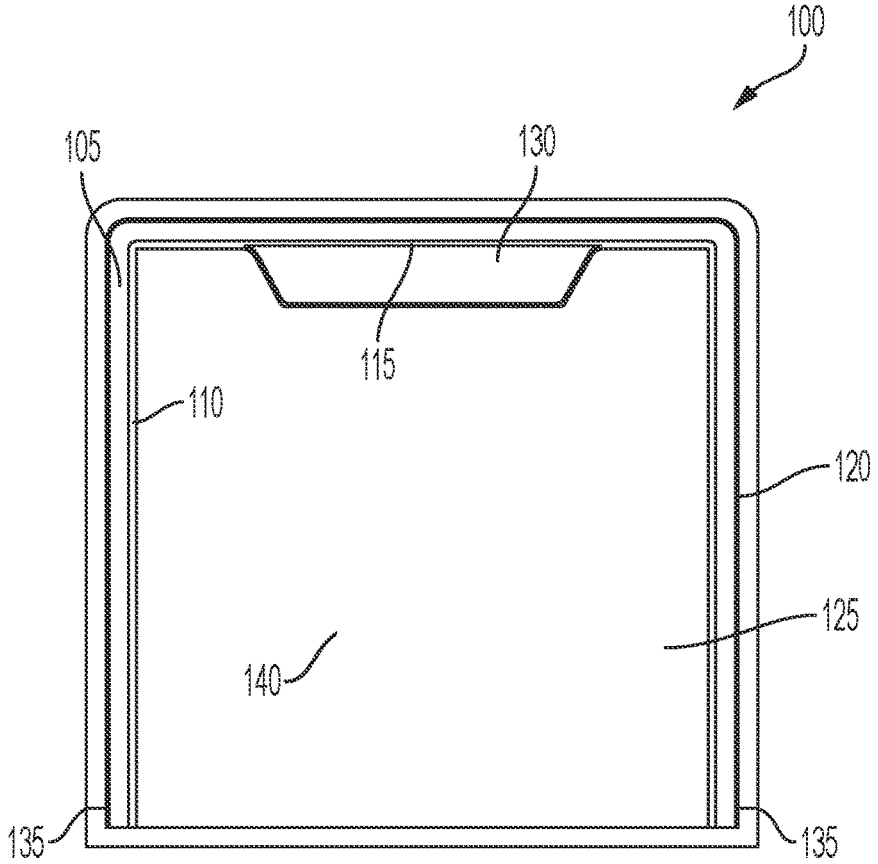

FIGS. 1A and 1B illustrate a tanning ledge insert according to various embodiments of the present disclosure. Although the term tanning ledge insert is used to describe an example embodiment of the present disclosure, the following descriptions may also apply to a variety of swimming pool inserts according to various disclosed embodiments. For example, a swimming pool insert according to the present disclosure may, but does not necessarily, include a section referred to as a "tanning ledge".

According to the embodiment of FIGS. 1A and 1B, a tanning ledge insert 100 may include multiple structural features substantially defining a region of a swimming pool, thereby enabling swimmers to rest in pool water without having to wade or float. A tanning ledge insert according to the present disclosure may include at least one vertical wall having a vertical wall upper surface 105 and a vertical wall lower surface. The upper surface may be configured to be at least substantially parallel (e.g., parallel) to the ground and/or the planned water surface after installation. The at least one vertical wall may be substantially vertical (e.g., about 90 degrees, 85 degrees, 80 degrees, etc., relative to a planned surface of the pool water and/or ground at installation).

For example, the tanning ledge insert 100 of FIGS. 1A and 1B has a plurality of vertical walls, including a left side wall 110, a rear wall 115, and a right side wall 120. Additionally, the tanning ledge insert may include multiple vertical walls that are substantially perpendicular relative to one another. For example, as shown in FIGS. 1A and 1B, the left side wall 110 may be substantially perpendicular to and connected to the rear wall 115, and the right side wall 120 may also be substantially perpendicular to and connected to the rear wall 115. Thus, the three vertical walls illustrated in FIGS. 1A and 1B may form three sides of a rectangle. Other shapes are also possible. For example, the at least one vertical wall may form a portion of a pentagon, hexagon, heptagon, etc.

Although FIGS. 1A and 1B illustrate three substantially flat (e.g., flat) vertical walls, a tanning ledge insert according to the present disclosure may have different wall geometries. For instance, the tanning ledge insert may have a single continuous wall that may be substantially concave relative to the swimming pool. The tanning ledge insert may also have two or more vertical walls, which may form convex and/or concave shapes. The at least one vertical wall may be curved or straight to provide support features, such as one or more inward protrusions that form a barrier and/or back support area. To reliably reproduce such complex shapes, the tanning ledge insert 100 may be substantially made of fiberglass or any other suitable material (e.g., carbon fiber, plastic, etc.). For example, fiberglass may be built up on a suitable fiberglass mold having the desired shape in any suitable way known in the art. In this way, a manufacturer may produce many tanning ledge inserts according to various embodiments quickly and at a reduced cost compared to traditional tanning ledge inserts.

FIGS. 1A and 1B also illustrate a tanning ledge 125 of the tanning ledge insert 100. For example, tanning ledge 125 may extend horizontally from the at least one vertical wall and have a tanning ledge depth measured between the tanning ledge's upper surface 140 and the vertical wall's upper surface 105. The tanning ledge 125 may be dimensioned to be substantially parallel to the water surface of a swimming pool upon proper installation of the tanning ledge insert 100. The tanning ledge 125 may also incorporate additional features, such as a curved lounge seat, or other undulations. In particular embodiments, the tanning ledge 125 may be, but is not necessarily, flat. Further, the tanning ledge 125 may be disposed perpendicular to the rear wall, the first side wall, and the second side wall.

The tanning ledge 125 may extend for a distance away from the at least one vertical wall suitable for a person to sit or lie down on the tanning ledge 125. For example, the tanning ledge 125 may extend from the at least one vertical wall for a distance greater than about 12 inches, such as at least about 36 inches, at least about 60 inches, at least about 80 inches, at least about 140 inches etc. In a particular embodiment the upper surface of the tanning ledge is substantially in the form of a rectangle, such as a rectangle having a length of about 7 to about 9 and a width of about 11 feet to about 13 feet. Further, in some embodiments, the tanning ledge 125 may extend from the rear wall 100 a distance equal to a distance between the left side wall 100 and the right side wall 120, such that the tanning ledge 125 is substantially square shaped. Alternatively, the tanning ledge 125 may extend a different distance and/or form other shapes, such as by including cutouts, protrusions, etc.

Further, in some embodiments, the vertical depth of the tanning ledge 125 may be between about 10 inches and about 24 inches (e.g., between about 10 and about 14 inches (e.g., about 12 inches)), between about 11 and about 13 inches, between about 14 and about 16 inches, between about 16 and about 18 inches, between about 18 and about 20 inches, between about 20 and about 22 inches, or between about 22 and about 24 inches). In various embodiments, the surface of the tanning ledge 125 may be at least substantially flat and horizontal. Tanning ledge depths in at least some of the ranges noted above may benefit user experience by providing sufficient depth to expose a swimmer to cool water, while also allowing the swimmer to recline without water covering his/her face. Additionally, depths in this range may provide buoyancy to offset the localized pressure of furniture feet, shoes, toys, pets, etc., thereby preserving the tanning ledge surface and structure, as well as allowing the swimmer to experience some buoyancy while remaining still and in contact with the tanning ledge surface.

Returning to FIGS. 1A and 1B, the tanning ledge insert 100 further includes a tanning ledge step 130 disposed adjacent (e.g., sitting on, immediately adjacent, nearby, etc.) the tanning ledge upper surface, contacting the at least one vertical wall, and having a step height less than the tanning ledge depth. In various embodiments, the surface of the step 130 may be at least substantially flat and horizontal. The step may enable easy, safe access to the tanning ledge 125, and may be dimensioned according to building code requirements for step sizes. As shown in FIGS. 1A and 1B, the tanning ledge step 130 may be at least substantially centered on the rear wall 115, for instance. Additionally, the tanning ledge step 130 may have a step width less than a distance between the first side wall and the second side wall. Thus the tanning ledge step 130 may have a smaller length than the length of the rear wall 115. In alternative embodiments, the tanning ledge step 130 may be offset, and may have the same length as the rear wall 115. Further, the tanning ledge step 130 may have beveled edges to help prevent injury to swimmers contacting the edges.

As shown in FIGS. 1A and 1B, in various embodiments, the tanning ledge insert 100 further includes a connection lip 135. The connection lip 135 may be a protrusion from the at least one vertical wall (e.g., substantially perpendicular to the at least one vertical wall). The connection lip 135 may be substantially planar, and may be continuous around the tanning ledge insert 100. Alternatively, connection lip 135 may be present in certain regions of the tanning ledge insert 100, such as along vertical walls, and be absent from other regions, such as along front-facing surfaces relative to a swimming pool when installed (e.g., a face of the tanning ledge 125), or include interruptions (e.g., periodic or intermittent gaps). The connection lip 135 may also include structural reinforcements and holes to accommodate fasteners (e.g., bolts, screws, etc.) The connection lip 135 may include a portion substantially parallel to a front surface of the tanning ledge insert 100 extending from a bottom portion of the tanning ledge insert 100 to a point that is adjacent (e.g., near) a top section of the tanning ledge insert. The connection lip 135 may also include a portion substantially perpendicular to the front surface of the tanning ledge insert 100 extending along a portion of a side wall (e.g., the left side wall 110 and/or the right side wall 120). A joint between the connection lip 135 and the rest of the tanning ledge insert 100 may be reinforced with ribs and/or fillets. The connection lip 135 may be formed as one piece with the remainder of tanning ledge insert 100, or may be made of a separate piece of material connected to the tanning ledge insert 100. In some embodiments, the material of the connection lip 135 may differ from the material of the rest of the tanning ledge insert 100. For example, material of the tanning ledge insert 100 may be fiberglass, and the material of the connection lip 135 may be metal, or may be reinforced with metal and covered by fiberglass. The connection lip 135 may be configured to cooperate with a swimming pool wall to secure the tanning ledge insert in place and, optionally, a portion of a perimeter of a vinyl pool liner. For instance, the connection lip 135 may engage with a fastener or other securing mechanism to hold an edge of a vinyl liner in place. The connection lip 135 may also engage with a structure, framework, or other swimming pool component to allow the tanning ledge insert 100 to be secured and sealed against the swimming pool to prevent leaks. For example, the connection lip 135 may be dimensioned and/or formed to allow for a waterproof connection between the tanning ledge insert 100 and the rest of the liner pool (e.g., by the formation of a waterproof connection and/or seal between the pool's liner and the tanning ledge insert 100).

Figure 2A:
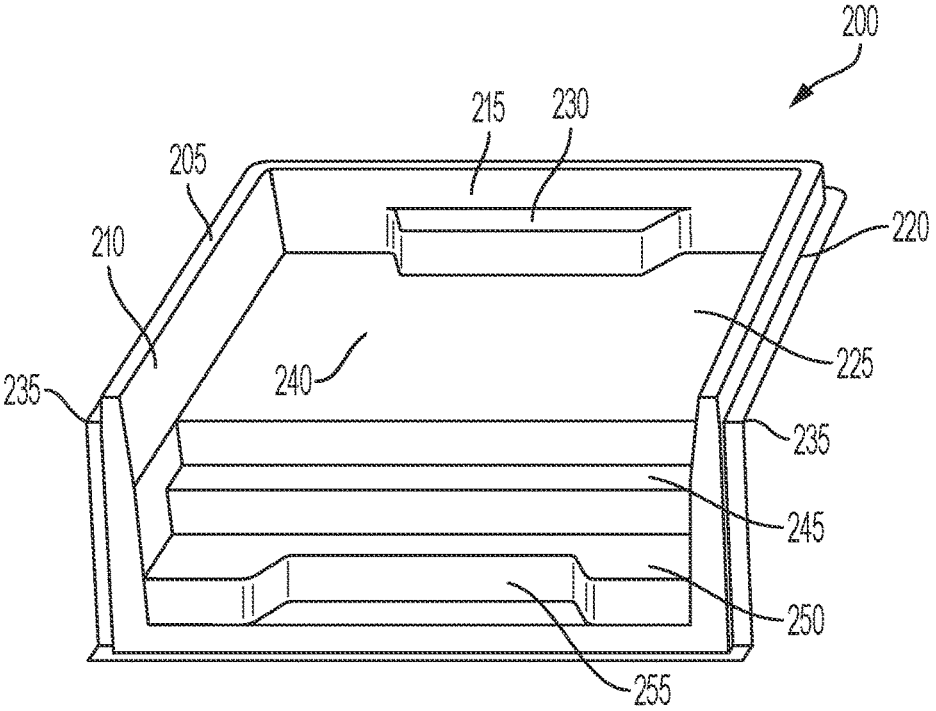
FIGS. 2A and 2B show perspective and plan views, respectively, of a tanning ledge insert according to various embodiments of the present disclosure.
Figure 2B:
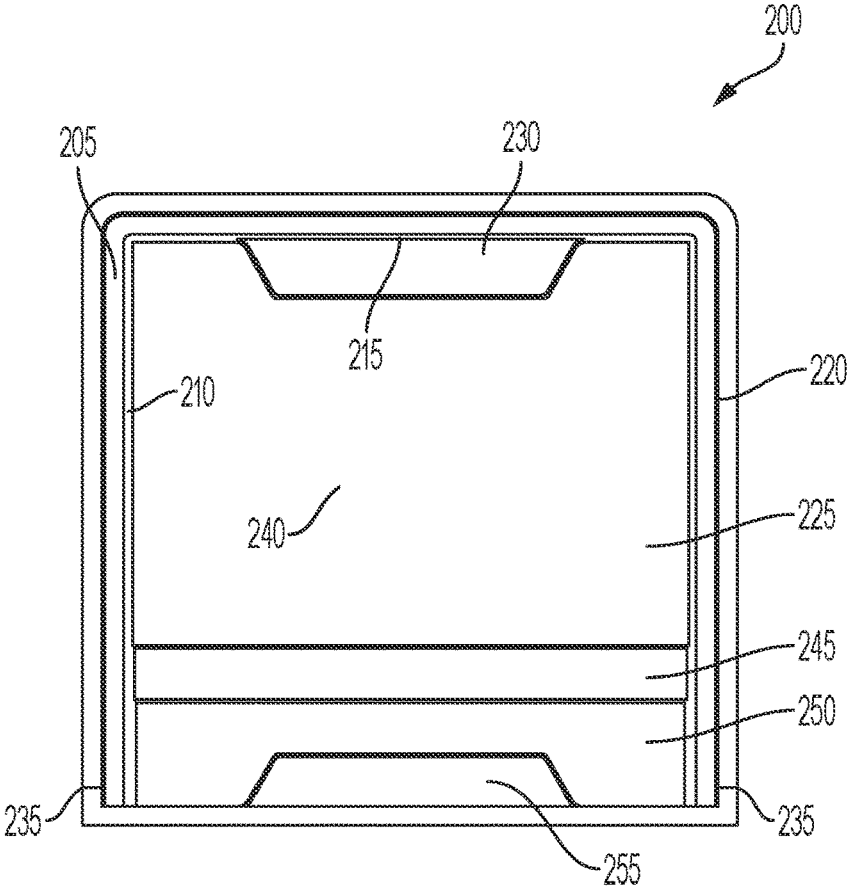

FIGS. 2A and 2B show perspective and plan views, respectively, of a tanning ledge insert 200 according to various embodiments of the present disclosure. As shown in FIGS. 2A and 2B, the tanning ledge insert 200 may further comprise at least one pool entry step 245, 250 to allow easier transition into a swimming or wading area of a swimming pool. Thus, the tanning ledge insert 200 may include at least one pool entry step 245 connected adjacent a free end of the tanning ledge and descending away from the tanning ledge's upper surface. For example, as shown in FIGS. 2A and 2B, the tanning ledge insert 200 may include a first pool entry step 245 and a second pool entry step 250, that are configured to cooperate to provide a descending path into the pool. Pool entry steps may include other features, such as a step cutout 255, to provide versatile pool entry options for people of differing abilities and sizes. Further, the step cutout 255 may provide an additional area for a swimmer to hang his/her feet while sitting on a shallower step or ledge. In some embodiments, the first and second pool entry steps 245, 250 may be centered between a first side wall and a second side wall of the tanning ledge insert 200. In particular embodiments, the tanning ledge insert 200 may be symmetric about a plane that bisects the tanning ledge insert 200.

Figure 3A:
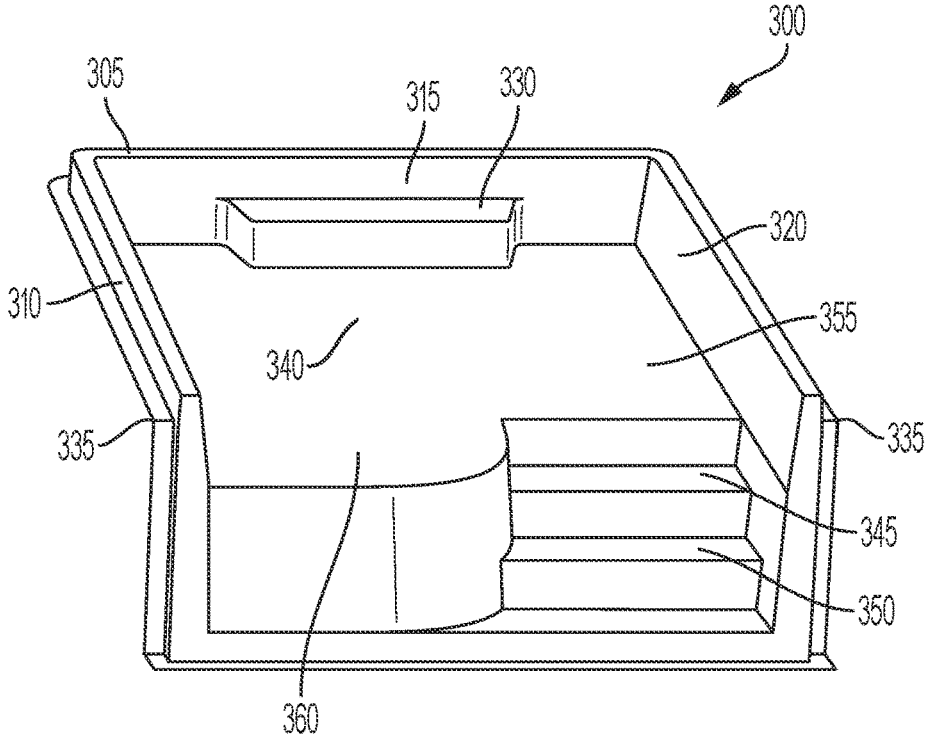
FIGS. 3A and 3B show perspective and plan views, respectively, of a tanning ledge insert according to various embodiments of the present disclosure.
Figure 3B:
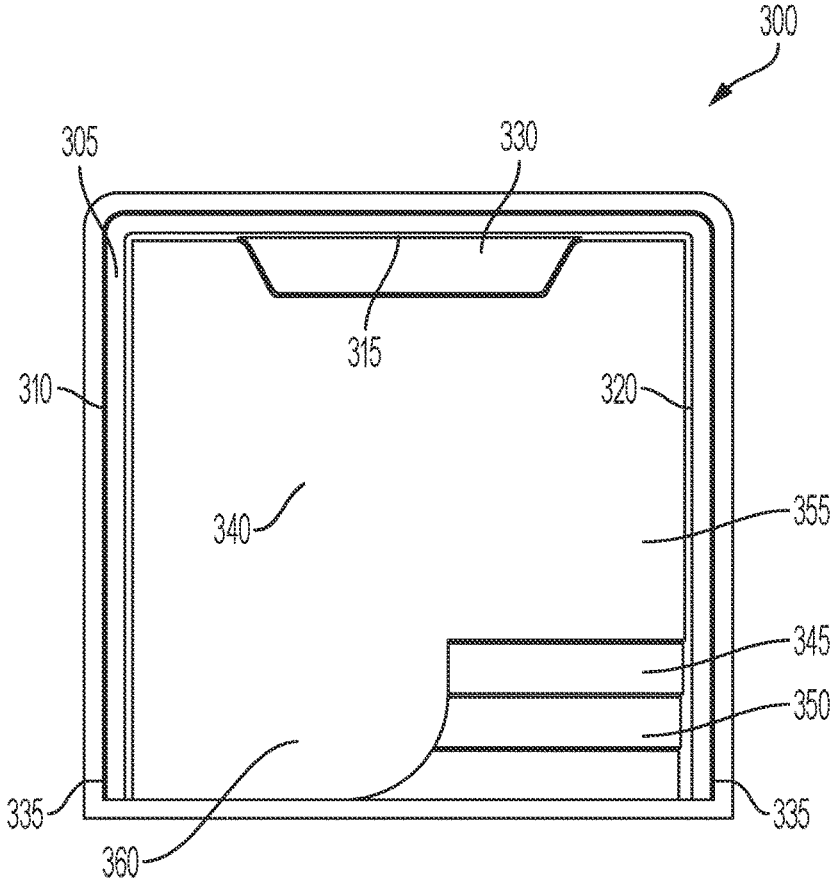

FIGS. 3A and 3B show perspective and plan views, respectively, of a tanning ledge insert according to various embodiments of the present disclosure. As shown in the embodiment shown in FIGS. 3A and 3B, the tanning ledge insert 300 may include a tanning area 355 and a sitting area 360. The tanning area 355 may have a platform width spanning a distance between the first side wall and the second side wall. Thus, as shown in FIGS. 3A and 3B, the tanning area 355 touches and extends between the tanning ledge insert's left side wall 310, rear wall 315, and the right side wall 320. Further, the sitting area 365 may extend outwardly from the tanning area 355 and have a sitting width less than the tanning area's platform width. For example, as shown in FIGS. 3A and 3B, the sitting area 360 contacts the left side wall 310, but does not contact the right side wall 320. Rather, a free end of the sitting area 360 is adjacent to the first and second pool entry steps 245, such that the first and second pool entry steps 245, 250 are disposed between the sitting area 360 and the right side wall 320. In some embodiments, the sitting area 360 may be disposed without contacting any of the at least one vertical walls (e.g., the sitting area 360 may protrude from a center portion of the tanning area 355). In the embodiment shown in FIGS. 3A and 3B, the sitting area 360 may allow swimmers to sit and hang their feet into deeper water without contacting a step. The sitting area 355 may include a rounded portion opposite a side wall and adjacent stairs, as shown in FIGS. 3A and 3B, or may have square edges or any other suitable shape.

Figure 4A:
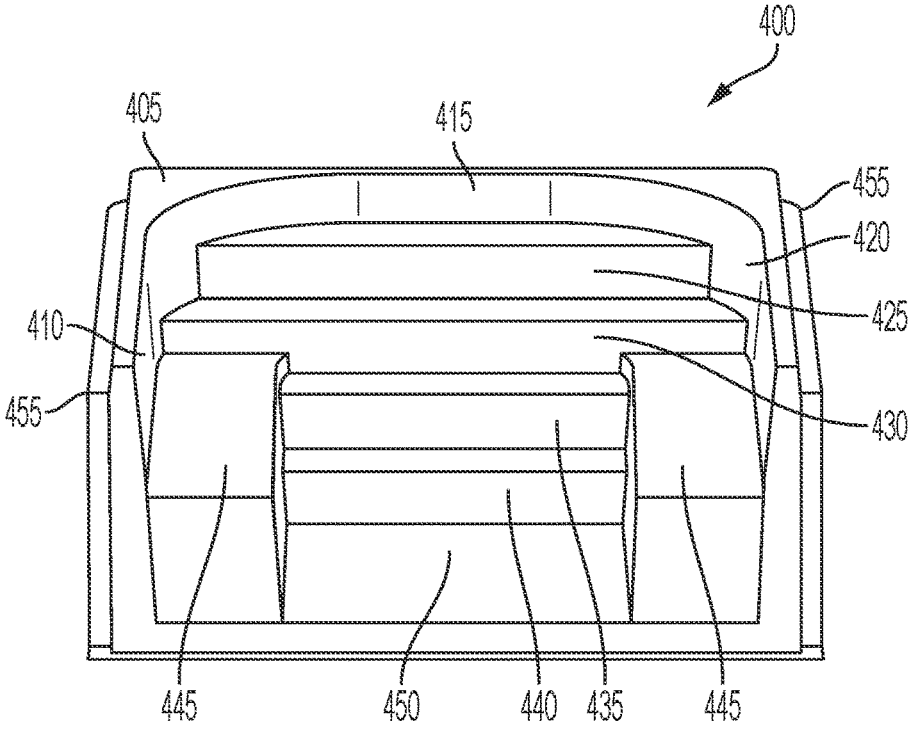
FIGS. 4A and 4B show perspective and plan views, respectively, of a swimming pool insert according to various embodiments of the present disclosure.
Figure 4B:
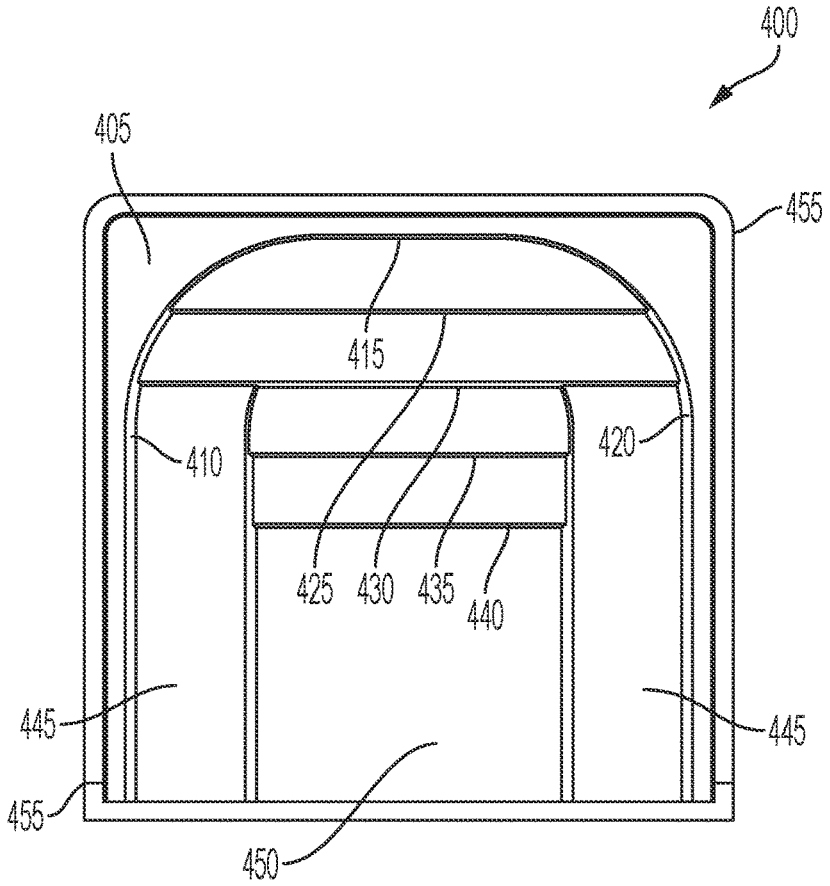

FIGS. 4A and 4B show perspective and plan views, respectively, of a swimming pool insert 400 according to various embodiments of the present disclosure. A swimming pool insert 400 may have one or more features described previously for embodiments of a tanning ledge insert as shown in FIGS. 1A, 1B, 2A, 2B, 3A, and 3B. For example, the swimming pool insert 400 shown in FIGS. 4A and 4B includes an upper surface 405, a left side wall 410, a rear wall 415, a right side wall 420, and a connection lip 455. The swimming pool insert 400 may further include a plurality of pool entry steps 425, 430, 435, and 440 descending progressively downwardly and terminating in a landing 450. The landing 450 may be disposed at a bottom of the at least one pool entry step, and may be parallel to the upper surface 405 of the swimming pool insert 400. The landing 450 may also parallel to the surface of pool water and/or ground when swimming pool insert 400 is installed. In some embodiments, the landing 450 may be inclined downward toward the swimming pool. The landing 450 may be substantially planar and may include a textured surface. The landing 450 may have a different thickness than other regions of the tanning ledge insert 400. For example, in some embodiments, the landing 450 may have thicker material to provide additional structural support to the tanning ledge insert 400. The landing 450 may span an area between a plurality of sitting ledges 445 (e.g., at least one), and/or, in certain embodiments, between a plurality of vertical wall sections. As shown in FIGS. 4A and 4B, the sitting ledges 445 may extend mutually parallel and perpendicular to the steps 425, 430, 435, and 440. In various embodiments, the respective upper surfaces of the sitting ledges 445 may be at least substantially flat and horizontal. The landing 450 may provide additional structural support to the swimming pool insert 400 during, for example, shipping, handling, and installation. The landing 450 may also provide a straight connection edge for a perimeter of a vinyl liner.

Figure 5A:
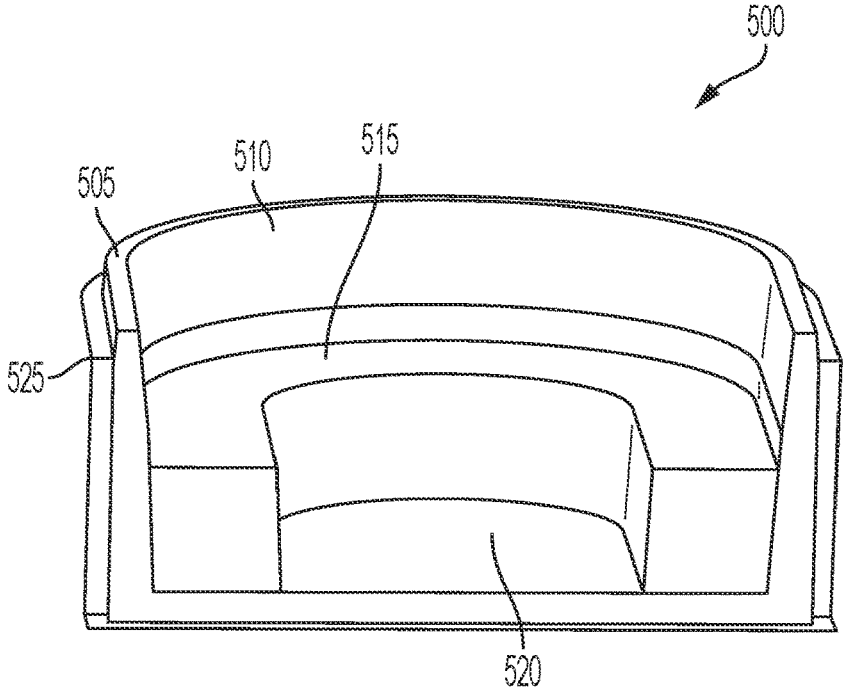
FIGS. 5A and 5B show perspective and plan views, respectively, of a swimming pool insert according to various embodiments of the present disclosure.
Figure 5B:
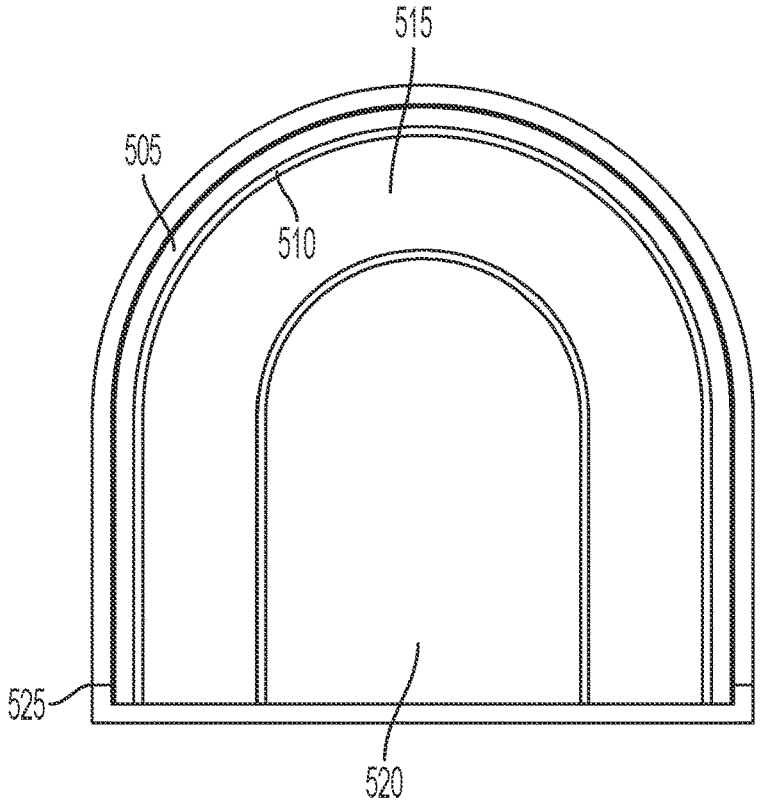

A further embodiment of a swimming pool insert is shown in FIGS. 5A and 5B. In this embodiment, the swimming pool insert 500 includes sitting ledge 515 that extends from a vertical wall 510. Similar to the swimming pool insert 400 shown in FIGS. 4A and 4B, the swimming pool insert 500 shown in FIGS. 5A and 5B also includes an upper surface 505, a landing 520, and a connection lip 525. Further, in alternative embodiments (not shown) the swimming pool insert 500 may incorporate a tanning ledge and/or tanning platform adjacent to the sitting ledge 515 and the vertical wall 510. Additionally, as shown in FIGS. 5A and 5B, in some embodiments, the swimming pool insert 500 may have a vertical wall 510 with a curved shape (e.g., substantially semi-circular in shape), and the sitting ledge 515 may follow the curved shape of the vertical wall 510 to provide a substantially U-shaped sitting area.

Figure 6:
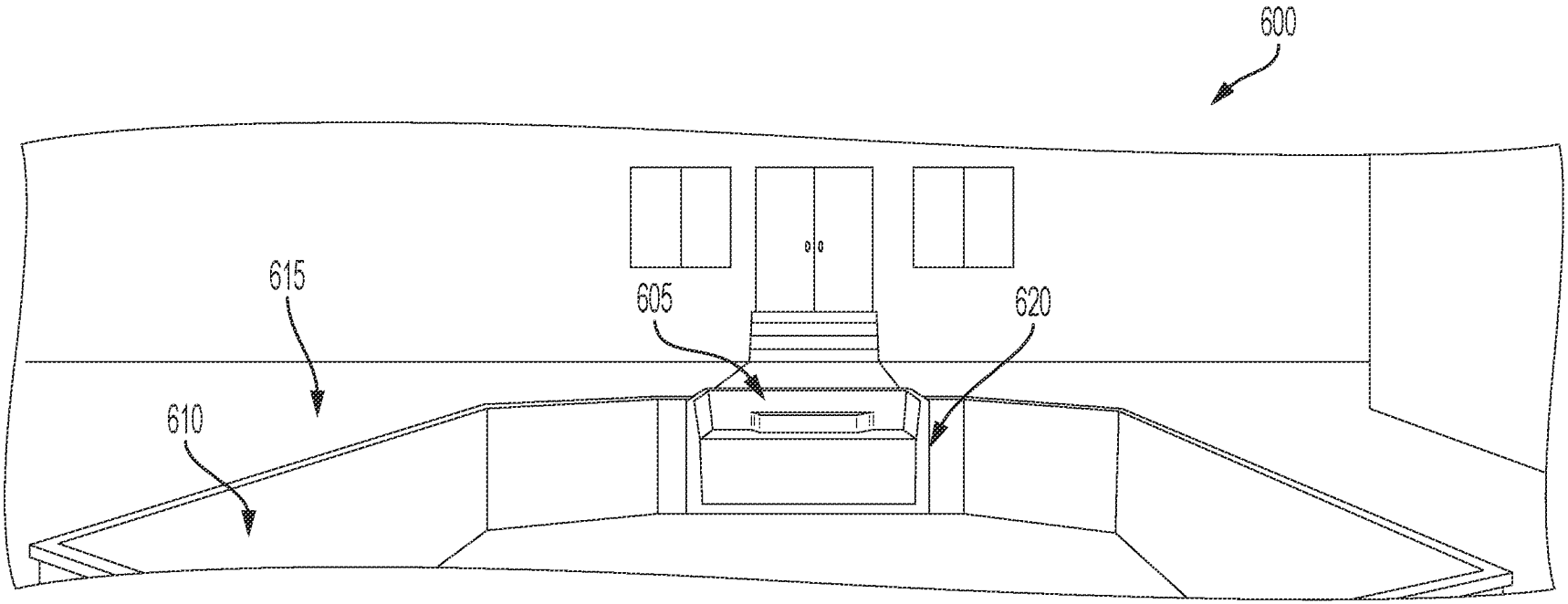
FIG. 6 shows a swimming pool assembly including the tanning ledge insert of FIGS. 1A and 1B according to various embodiments of the present disclosure.

FIG. 6 shows a swimming pool assembly including a tanning ledge insert according to various embodiments of the present disclosure. Accordingly, FIG. 6 illustrates an exemplary manner in which a tanning ledge insert may be incorporated into a swimming pool. The swimming pool 600 may be constructed with a swimming pool frame 610 defining a perimeter of a swimming pool. The swimming pool frame 610 may be constructed from wood, metal, or any other suitable material. In some embodiments, the swimming pool frame 610 may abut a tanning ledge insert 605 at at least one joint 620. For example, a connection lip may include holes to accept screws or other fasteners to secure the tanning ledge insert 605 to the swimming pool frame 610. In vinyl pool applications, a vinyl liner may be attached at the joint 620, for example, so as to form a waterproof connection and/or seal between the vinyl liner and the tanning ledge insert 605 and/or the connection lip 135. Further, as shown in FIG. 6, the volume of swimming pool 600 may be excavated from the ground 615. As a result, in some embodiments, an upper surface of tanning ledge insert 605 may lie substantially parallel to and even with the ground level around the perimeter of the pool.

Figure 7:
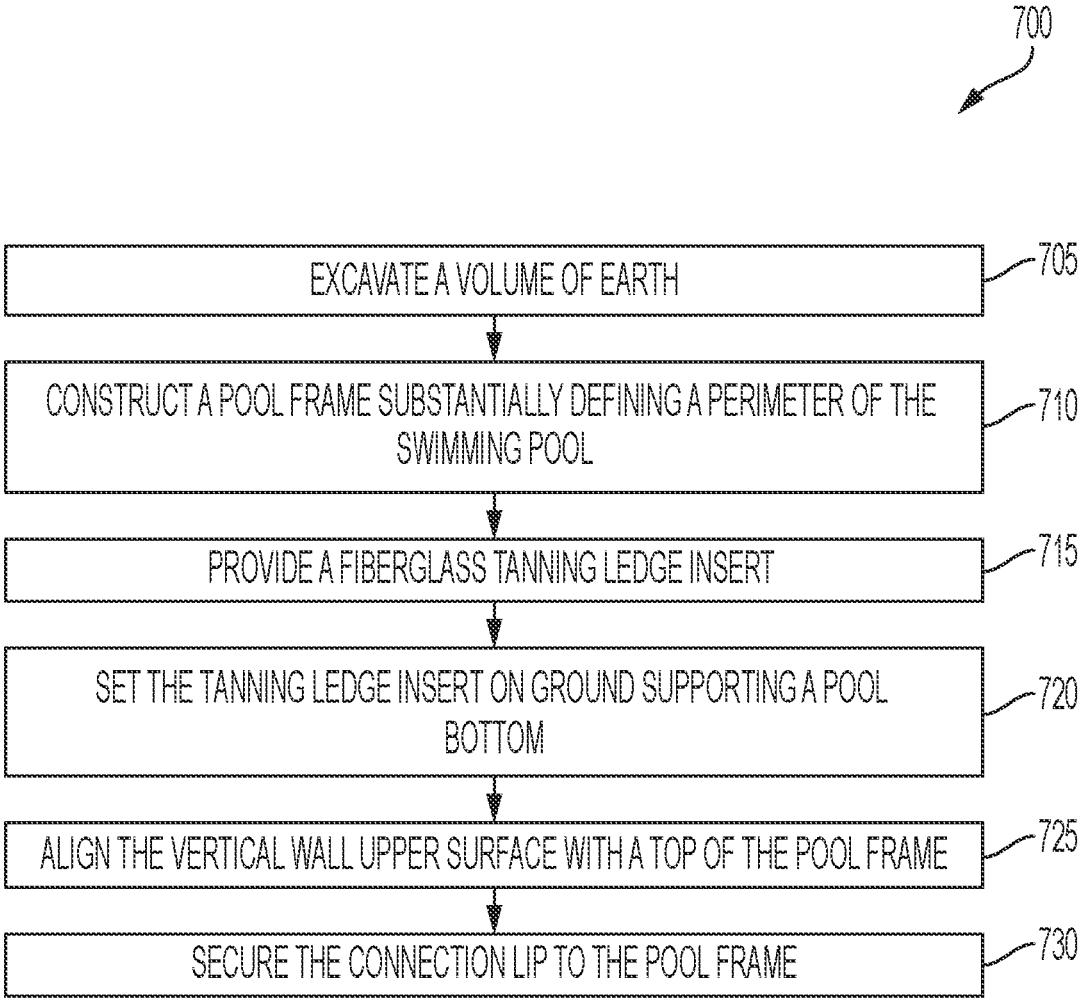
FIG. 7 shows a process diagram for installing a swimming pool including a tanning ledge insert according to various embodiments of the present disclosure.

FIG. 7 shows a process diagram for installing a swimming pool including a tanning ledge insert according to various embodiments of the present disclosure. For example, the process 700 of FIG. 7 may be used to construct the swimming pool 600 of FIG. 6. It should be understood that the various operations are not inclusive and may be performed in an alternative order without departing from the scope of this disclosure.

According to one embodiment, the process 700 begins at step 705 with excavating a volume of earth. The excavated volume may substantially define the volume of a swimming pool, for instance. Further, the excavated volume may also include a region dimensioned to accommodate a tanning ledge insert. In some scenarios, step 705 may also include adding substrate material (e.g., dirt, rock, gravel, concrete) to support swimming pool components added later during process 700.

Step 710 includes constructing a pool frame substantially defining a perimeter of the swimming pool within the excavated volume. The pool frame may be constructed by joining pieces of metal, wood, or any other suitable material. The frame may be at least partially beneath ground level. That is, a portion of the frame may or may not extend above ground level. The frame may contain regions not intended to be filled with water. For instance, some portions of the volume enclosed by the frame may be configured to house pool support equipment, such as piping, pumps, filters, heaters, etc. The frame may include a cutout portion (e.g., a discontinuous portion of the frame) dimensioned to accept a tanning ledge insert.

Step 715 includes providing a fiberglass tanning ledge insert, such as, for example a tanning ledge insert including, for example, one or more features illustrated in FIGS. 1A, 1B, 2A, 2B, 3A, 3B, 4A, 4B, and/or 5A and 5B. For instance, the tanning ledge insert provided at step 715 may include a vertical wall, a vertical wall upper surface, a tanning ledge, a step, and a connection lip.

Step 720 includes setting the tanning ledge insert on ground that is to support a pool bottom. The tanning ledge insert may be positioned in the cutout portion of the pool frame, such that a front face of the tanning ledge insert is aligned with the pool frame, with the remainder of the tanning ledge insert being recessed outside of the perimeter of the pool frame. The cutout portion may include a support structure, such as one or more braces or cross members, to provide additional structural support. The braces and/or cross members may span the cutout portion (e.g., along the ground), and may be anchored to the surrounding soil by concrete. In this manner, the frame may maintain structural strength despite having a cutout, and may also avoid transferring load to the tanning ledge insert.

Step 720 may also include aligning the connection lip with the pool frame so that the connection lip and the pool frame interact and may be connected using, for instance, screws, bolts, pressure fittings, etc. Further, the tanning ledge insert may be placed on prepared ground. For instance, earth or other substrate material such as gravel may be added and/or compacted to improve structural stability prior to placement of the tanning ledge insert. Additionally, concrete may be poured and function as a support substrate. This may allow transfer of pressure from the tanning ledge insert into a foundation, reducing strain on the tanning ledge insert. In some scenarios, step 720 may include backfilling a support substrate underneath the tanning ledge insert for structural support. For instance, earth may be shoveled and packed under the support structure, or concrete may be poured.

Step 725 includes aligning the tanning ledge insert's vertical wall upper surface with a top of the pool frame. Step 725 may include additional compacting of ground or addition of substrate in order to provide a suitable foundation for the tanning ledge insert and enable alignment with the pool frame and upper surface. In some embodiments, step 725 may also include alignment of pre-drilled holes in the connection lip with holes drilled in the support frame. This may provide a continuous upper rim of the swimming pool.

Step 730 includes securing the connection lip to the pool frame. The connection lip may be secured to the pool frame using screws, nails, suitable waterproofing material, mechanical fasteners, or any other suitable connection mechanism. Step 730 may further include providing bracing structures (e.g., cross members, foundation tie ins, etc.) to give additional support to the pool frame and maintain contact with the fiberglass tanning ledge insert without adding lateral forces (compressive or tensile) to the vertical walls of the tanning ledge insert, which may be weaker than the surrounding frame due to a gap, as well as material difference.

The swimming pool installation process 700 may further include additional steps related to vinyl-lined pools. For instance, after the pool frame is constructed and the tanning ledge insert secured, a vinyl liner may be laid along a surface of the excavated volume at least partially defined by the pool frame. The liner may be stretched and formed to the shape defined by the excavated volume. The liner may also be secured to the perimeter of the swimming pool. Further, an edge of the vinyl liner may be secured to the tanning ledge insert at least partially along a path defined by the connection lip. The edge may be secured mechanically, for instance, by a compression fitting into a recess of the tanning ledge insert. Sealant may also be introduced at or near the connection to prevent water leakage through the connection. In this manner, the tanning ledge insert may remain uncovered by the vinyl liner. In this embodiment, the vinyl liner does not substantially cover (e.g., does not cover) the tanning ledge insert, and thus the tanning ledge insert may be detached from the vinyl liner without substantially damaging the vinyl liner. Further, in this embodiment, horizontal portions of the vinyl liner may be protected by buoyancy provided by deeper water, while the tanning ledge insert, which may be made from a more durable material such as fiberglass, may remain exposed to shallower depths and higher localized pressure from furniture, pets, and toys, as described herein.

Various embodiments of the process described above may also be adapted to installing a gunite pool having a non-gunite (e.g., fiberglass) tanning ledge. As described previously, gunite pool tanning ledges are often covered in the same surface material as the remainder of the swimming pool. If the tanning ledge is damaged, it may be desirable to replace only the tanning ledge portion, rather than the entire swimming pool surface. The surface finish of a tanning ledge insert may also be more comfortable for swimmers. For instance, fiberglass may provide a smooth, nonabrasive texture that is more comfortable to a sunbather than coarse gunite surfaces. Thus, a tanning ledge insert according to the present disclosure may be incorporated into a gunite pool by installing gunite within the excavated volume to form a surface of the swimming pool, while leaving the tanning ledge insert uncovered by gunite.

Figure 8:
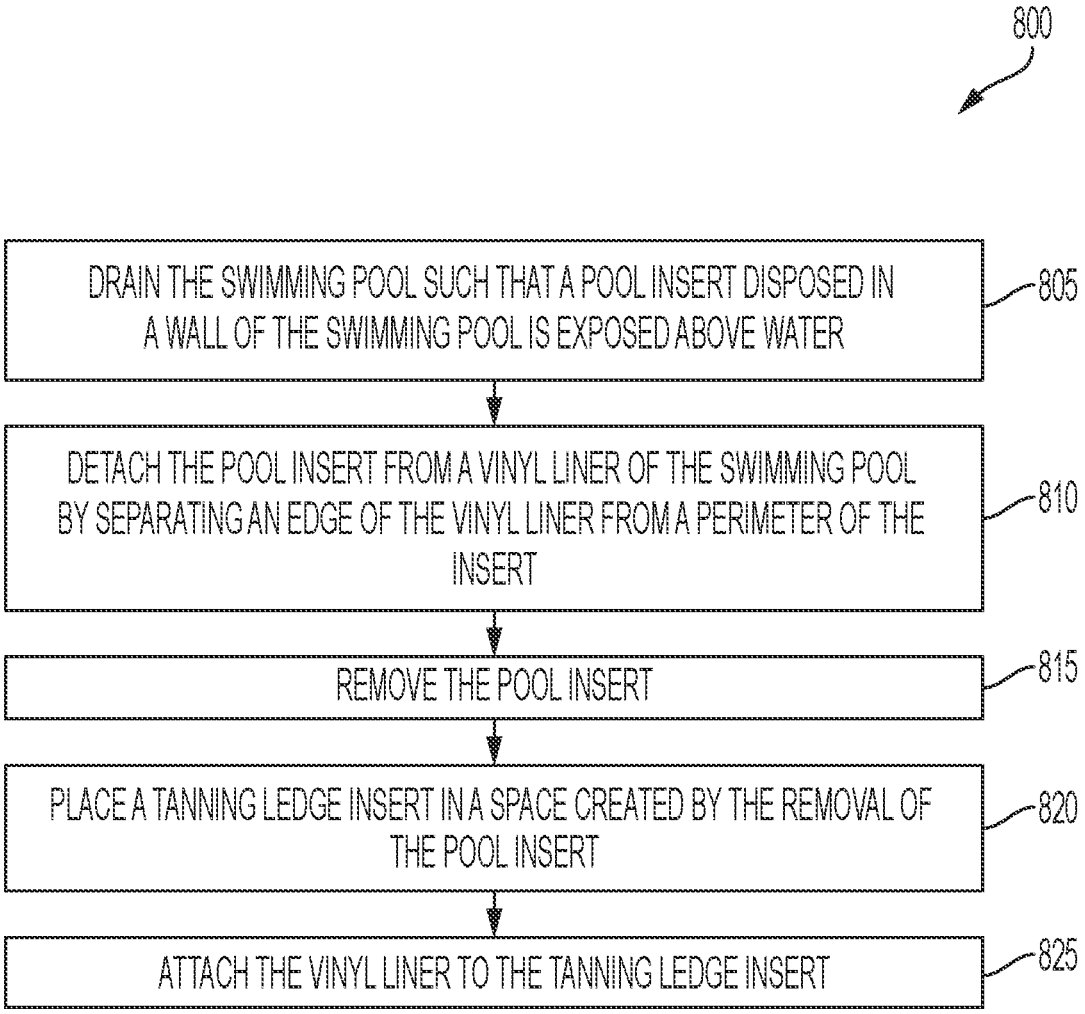
FIG. 8 shows a process diagram for repairing a swimming pool having a pool insert according to various embodiments of the present disclosure.

FIG. 8 shows a process diagram for repairing a swimming pool having a pool insert according to various embodiments of the present disclosure. As discussed above, one advantage of a swimming pool having a tanning ledge insert according to embodiments of the present disclosure is that the tanning ledge insert may be easily replaced. A pool owner may hire a pool constructor to repair a broken tanning ledge insert, or upgrade to a new tanning ledge insert having a different style or additional features (e.g., lights, speakers, seating, jets, heaters, color, seating arrangement, etc.) using the process 800 of FIG. 8.

The process 800 of FIG. 8 begins with draining the swimming pool such that a pool insert disposed in a wall of the swimming pool is exposed above water. Because swimming pools often have portions of varying depth it may be advantageous to drain only enough water to expose the tanning ledge insert, leaving a significant portion of the water in the pool and thus reducing costs and waste.

At step 810, the process 800 may include detaching the pool insert from a vinyl liner of the swimming pool by separating an edge of the vinyl liner from a perimeter of the pool insert. This may include removing clips or other retaining mechanisms, dissolving glue or sealant, etc. Further, step 810 may include removing mechanical fasteners, such as screws, from a frame of the swimming pool. In some embodiments, such as for gunite pools, this step 810 may be omitted, and instead the pool insert may be detached from a support structure without detaching a vinyl liner. After the pool insert has been detached from the surrounding support structure and vinyl liner, the pool insert may be removed at step 815. In some embodiments, this may include cutting the pool insert or other destructive methods.

A tanning ledge insert may be placed in a space created by the removal of the pool insert at step 820. The tanning ledge insert may be, for example, a tanning ledge insert including features illustrated in FIGS. 1A, 1B, 2A, 2B, 3A, 3B, 4A, 4B, and/or 5A and 5B. For instance, the tanning ledge insert provided at step 820 may include a vertical wall, a vertical wall upper surface, a tanning ledge, a step, and a connection lip.

Step 820 may also include further excavation of the space left by the removal, such as if the tanning ledge insert has a different shape from the pool insert. Additionally or alternatively, step 820 may include adding additional backfill material to support the different structure of the tanning ledge insert. In some embodiments, such as when the tanning ledge insert includes additional features (e.g., pumps, heaters, lights), conduit lines and/or piping may be added during step 820 as well.

At step 825, the vinyl liner of the swimming pool may be attached to the tanning ledge insert. The seam between the tanning ledge insert and the vinyl liner may be sealed with heat, mechanical compression of the liner in a crevice of the tanning ledge insert or other sealing mechanisms consistent with embodiments of the present disclosure. The swimming pool may be refilled and checked for leaks as well. In embodiments involving a gunite pool, step 825 may be modified to omit the attachment of a vinyl liner, and instead include attachment to the pool structure and other suitable sealing techniques.

CONCLUSION

Many modifications and other embodiments of the disclosure will come to mind to one skilled in the art to which this disclosure pertains having the benefit of the teachings presented in the foregoing descriptions and the associated drawings. For example, as will be understood by one skilled in the relevant field in light of this disclosure, the embodiments may take form in a variety of different mechanical and operational configurations. Therefore, it is to be understood that the disclosure is not to be limited to the specific embodiments disclosed herein, and that the modifications and other embodiments are intended to be included within the scope of the appended exemplary concepts. Although specific terms are employed herein, they are used in a generic and descriptive sense only and not for the purposes of limitation.

What is claimed is:

1. A tanning ledge insert for a swimming pool comprising:
at least one vertical wall comprising:
a vertical wall upper surface;
a rear wall;
a first side wall substantially perpendicular to and connected to the rear wall; and a second side wall substantially perpendicular to and connected to the rear wall;

a tanning ledge extending horizontally from the at least one vertical wall and having a tanning ledge vertical depth measured between a tanning ledge upper surface and the vertical wall upper surface;

a step disposed on top of the tanning ledge upper surface, contacting the at least one vertical wall, and having a step height less than the tanning ledge depth; and a connection lip configured to cooperate with a swimming pool wall to secure the tanning ledge insert; wherein:

the tanning ledge is disposed substantially perpendicular to the rear wall, the first side wall, and the second side wall; and the tanning ledge comprises a tanning platform having a platform width spanning a distance between the first side wall and the second side wall.

2. The tanning ledge insert of claim 1, wherein the tanning ledge depth is between about 12 and about 24 inches.

3. The tanning ledge insert of claim 1, wherein the tanning ledge depth is between about 14 and about 16 inches.

4. The tanning ledge insert of claim 1, wherein the tanning ledge extends from the at least one vertical wall for a distance of about 7 feet to about 9 feet.

5. The tanning ledge insert of claim 1, wherein the platform width is about 11 feet to about 13 feet.

6. The tanning ledge insert of claim 1, wherein the tanning ledge insert is substantially made of fiberglass.

7. The tanning ledge insert of claim 1, wherein the connection lip comprises a portion parallel to a front surface of the tanning ledge insert and extending from a bottom portion of the tanning ledge insert.

8. The tanning ledge insert of claim 1, wherein a joint between the connection lip and the vertical wall is reinforced with at least one of a rib or a fillet, and the connection lip comprises reinforcing metal.

9. The tanning ledge insert of claim 1, wherein the step is so dimensioned as to comply with building code requirements for step sizes.

10. The tanning ledge insert of claim 1, wherein the connection lip is continuous around the tanning ledge insert.

11. The tanning ledge insert of claim 1, wherein the tanning ledge insert is configured to seal against the swimming pool such that water does not leak behind the tanning ledge insert.

* * * * *